US006856093B2

(12) United States Patent
Little et al.

(10) Patent No.: US 6,856,093 B2
(45) Date of Patent: Feb. 15, 2005

(54) ELONGATE ULTRAVIOLET LIGHT SOURCE

(75) Inventors: Richard Little, Southampton (GB); David Briggs, Reading (GB)

(73) Assignee: JenAct Limited, Hants (GB)

( * ) Notice: Subject to any disclaimer, the term of this patent is extended or adjusted under 35 U.S.C. 154(b) by 20 days.

(21) Appl. No.: 10/394,871

(22) Filed: Mar. 21, 2003

(65) Prior Publication Data

US 2003/0197476 A1 Oct. 23, 2003

(30) Foreign Application Priority Data

Mar. 21, 2002 (GB) ..... 0206673

(51) Int. Cl.[7] ..... H01J 7/46

(52) U.S. Cl. ..... 315/39; 315/39.51; 315/248; 313/231.61; 118/723 MW

(58) Field of Search ..... 315/248, 39, 39.51, 315/37.55, 267, 344; 313/231.61, 231.71, 231.51; 118/723 MW; 204/298.38; 156/345.41

(56) References Cited

U.S. PATENT DOCUMENTS 2,942,204 A * 6/1960 Howard ..... 331/78
3,806,837 A * 4/1974 Carr et al. ..... 333/1.1
4,042,850 A * 8/1977 Ury et al. ..... 315/39
4,063,132 A 12/1977 Proud et al. ..... 315/248
4,161,436 A 7/1979 Gould ..... 204/157.1
4,933,602 A 6/1990 Ono et al. ..... 315/39
6,028,315 A 2/2000 Bailey et al. ..... 250/455.11
6,348,669 B1 2/2002 Rudd Little et al. .... 219/121.43

FOREIGN PATENT DOCUMENTS

JP 5-62649 3/1993

* cited by examiner

*Primary Examiner*—Haissa Philogene
(74) *Attorney, Agent, or Firm*—Synnestvedt & Lechner LLP

(57) ABSTRACT

It is desirable to be able to provide evenly illuminated, long lasting, relatively high power ultraviolet radiation for manufacturing processes such as sterilization and ink or adhesive curing. A generally rigid waveguide (2) having a slot (8) formed in one of its short sides (4) (or optionally one of its long sides (6)) may have an ultraviolet energizable elongate lamp (10) inserted therein. When the waveguide is coupled to a source of microwave energy, the slot radiates and the radiated energy is coupled almost exclusively into the lamp (10). With suitable choices of slot widths this provides even illumination with minimal microwave leakage.

13 Claims, 3 Drawing Sheets

ELONGATE ULTRAVIOLET LIGHT SOURCE

CROSS REFERENCE TO RELATED APPLICATION

This application is based on and claims priority to U.K. Application No. 0206673.6, filed Mar. 21, 2003.

FIELD OF THE INVENTION

This invention relates to a coupler for coupling microwave energy into an elongate microwave energisable lamp and also to an elongate ultraviolet light source.

BACKGROUND OF THE INVENTION

It is well known to generate ultraviolet light using a microwave energisable light source. Such light sources are described, for example, in GB-A-2336240 and typically comprise an ultraviolet-transparent envelope (typically formed from quartz) which contains a pressurised gas fill (typically of mercury and a noble gas such as argon) which when energised at microwave frequencies emits light through the envelope walls from the plasma gas fill.

As has been noted in the prior art mentioned above (and the prior art discussed in the introduction thereto) there are two significant problems which must be overcome in order to make practical use of such microwave energisable lamps.

The first of these problems is that of microwave leakage. Generally speaking, microwave radiation is hazardous and therefore it is necessary to ensure that the microwave energy used to energise the bulb is contained. This, however, is usually in direct conflict with the need to allow radiation of the ultraviolet energy.

The second problem is that of even illumination of the quartz envelope. This is, particularly important for adhesive and paint curing applications in which is undesirable to over or under expose adjacent portions of the paint or adhesive. It may also be critical in germicidal applications although in practice, over exposure of articles to ultraviolet radiation for germicidal applications is not as critical as it is for curing applications.

The problem of even illumination becomes particularly acute when it is desired to illuminate over a large area. For example for areas having a minimum dimension of 150 mm or more.

SUMMARY AND OBJECTS OF THE INVENTION

It is therefore an object of the present invention to provide an ultraviolet light source which provides relatively even illumination at relatively high powers over a potentially large area, for example, having a minimum dimension of $2\lambda/3$ where $\lambda$ is the microwave wavelength (which gives approximately 80 mm for a 2.45 $GH_z$ microwave source).

In accordance with a first aspect of the invention there is provided an elongate ultraviolet light source comprising an elongate microwave energisable lamp and a generally rigid waveguide having a generally rectangular cross section and four generally planar, elongate walls, one of the walls defining a slot which passes through the entire thickness of the wall, the bulb being partially inserted into or laid over the slot and the waveguide being couplable to a source of microwave energy such as a magnetron.

This construction as explained below, provides a relatively high power elongate light source which may, for example, be placed over a conveyor belt web. Thus continuous sterilisation or curing or articles passing beneath the light source on the web may be achieved. If, for example, the length of the lamp is 150 mm, then it will be noted that articles of width 150 mm at any desired length may be irradiated with ultraviolet radiation.

In accordance with a second aspect of the invention, there is provided a coupler, wherein the waveguide walls are of differing widths and comprise a pair of wide wall and a pair of narrow walls, and wherein the slot is defined in one of the narrow walls.

BRIEF DESCRIPTION OF THE DRAWINGS

Embodiments of the invention will now be described by way of example with reference to the drawings in which.

DETAILED DESCRIPTION OF THE PREFERRED EMBODIMENTS

Figure 1:
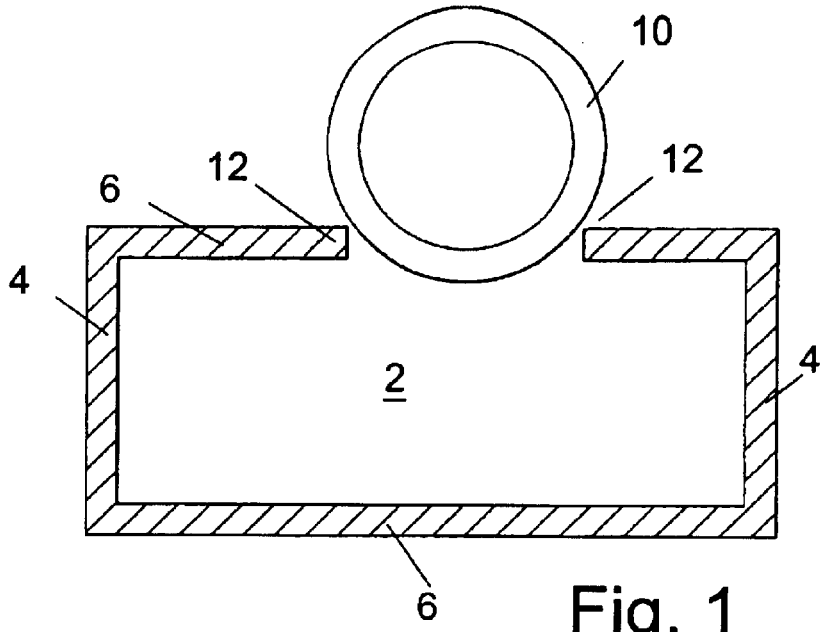
FIG. 1 is a cross-sectional view of a wave guide and microwave energisable lamp combination.

With reference to FIG. 1, a waveguide 2 is formed from a generally rigid and electrically conductive material such as stainless steel. The dimensions of the waveguide are tuned to the desired frequency using conventional transmission line calculations. In this example the desired frequency is the common microwave frequency of 2.45 GHz. Other frequencies may be used consistent with the desired spectral output of the lamp.

Figure 2:
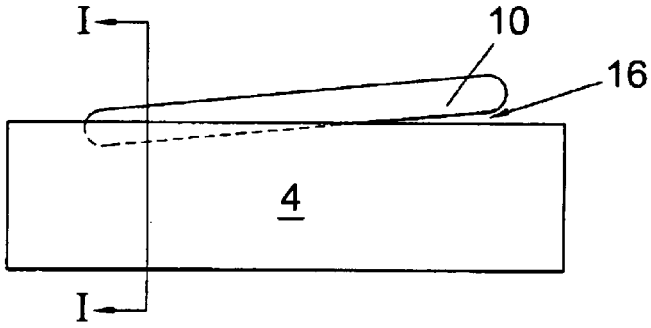
FIG. 2 is a side elevation of the lamp and waveguide combination of FIG. 1.
Figure 3:
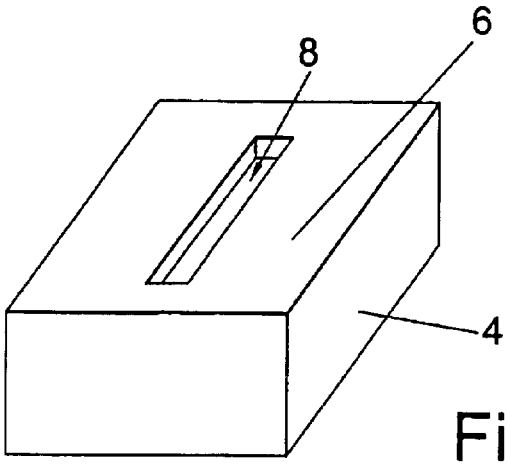
FIG. 3 is a schematic perspective view of a waveguide coupler in accordance with the invention.

As is well known, rigid waveguides of the form shown in FIG. 1 have a generally rectangular configuration having a pair of short sides 4 and a pair of long sides 6. With reference also to FIGS. 2 and 3, the waveguide has a slot 8 formed in one of the sides or walls of the waveguide 2. The drawings show the slot shown in the long sides 6. It is equally probable and perhaps more likely (depending on the standing wave patterns within the waveguide 2) that the slot be formed in the short sides 4.

With particular reference to FIG. 2, an elongate microwave energisable lamp 10 is inserted into the slot and is a close mechanical fit with the edges 12 of the slot.

By cutting a slot in the waveguide, the energy normally contained within the waveguide is caused to radiate through the slot 8. However, by inserting the lamp 10 partially into the slot as shown, for example, in FIG. 2, the energy is caused to energise the lamp 10 and does not leak from the waveguide or lamp since the close mechanical fit between the lamp 10 and the waveguide prevents leakage around the lamp and radiation entering the lamp is attenuated to insignificant levels by virtue of its conversion into ultraviolet light and heat by the lamp.

In practice, the waveguide will be fed with microwave energy from one end. If the slot were to have uniform width and the lamp 10 were inserted to be entirely parallel with the waveguide wall containing the slot, it is found that the illumination intensity reduces with distance from the end of the waveguide into which microwave energy is coupled. Several ways of overcoming this problem and equalising the illumination are now described.

Figure 4A:
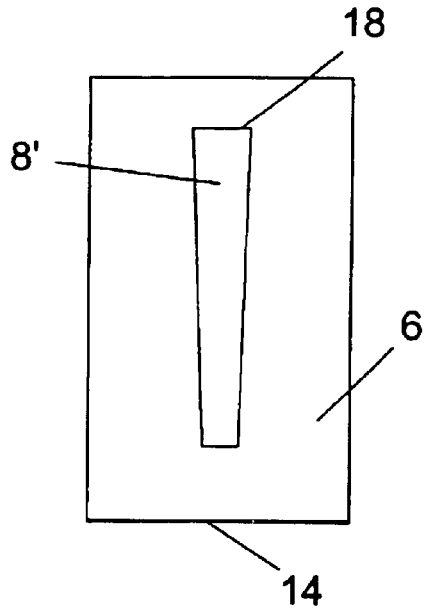
FIG. 4A is a plan view of the waveguide coupler of FIG. 3 with a first preferred slot arrangement.

Firstly, with reference again to FIG. 2, one option is to use a slot 8' of the form shown in FIG. 4A. The slot widens with distance from the fed end of the waveguide 14 so that (using a bulb having a generally uniform diameter and circular cross-section) the bulb is caused to gently incline into the waveguide as shown in FIG. 2. It will be noted that the gap 16 shown in FIG. 2 is greatly exaggerated for illustrative purposes. In practice this gap will be much smaller to prevent leakage of microwave radiation.

The widening of the slot has two effects. Firstly, it allows the bulb to be inclined into the waveguide as shown in FIG. 2 which increases the coupling of energy into the portion of the bulb which is inserted further into the waveguide wall. Secondly, the width of the slot directly affects the intensity of radiation of microwave energy from the waveguide along the length of the slot. Generally speaking, a wider slot radiates more energy. Thus, a combination of the bulb being inserted further into the waveguide and the radiation intensity being increased is used to compensate for a reduction in intensity of ultraviolet light input with distance from the coupled end of the waveguide 14.

Figure 4B:
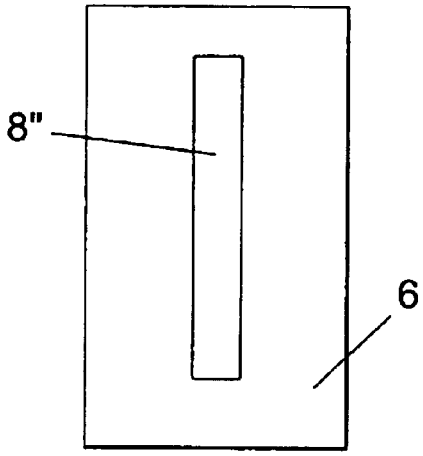
FIG. 4B is a plan view of the waveguide coupler of FIG. 3 with a second preferred slot arrangement.

FIG. 4B shows a slot 8" having a uniform slot width which may be acceptable in applications where variations in light intensity are acceptable, or for example, in applications in which the dimensions of the bulb are not uniform.

Figure 4C:
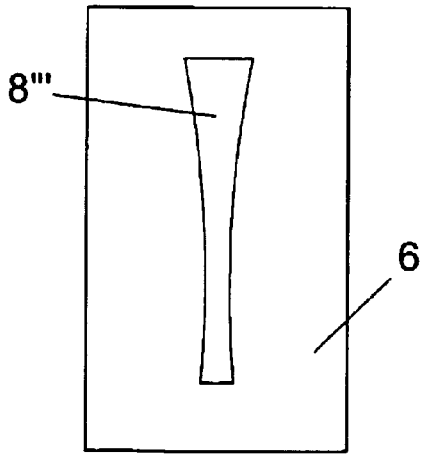
FIG. 4C is a plan view of the waveguide coupler of FIG. 3 with a third preferred slot arrangement.

FIG. 4C shows a further embodiment in which a slot 8'" is formed with an exponential variation in width along its length. This illustrates that the slot need not have uniform variations of its width along its length and indeed may have notches and other features in order to compensate for small variations in intensity along the length of the bulb.

Figure 5:
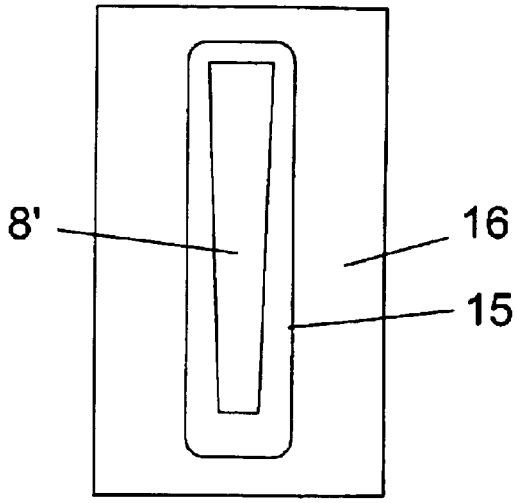
FIG. 5 is a plan view of the waveguide coupler with a bulb laid thereon.

With reference to FIG. 5, a plan view of a waveguide (using the slot shape of FIG. 4*a* as an example) is shown. A bulb 15 is shown overlying the slot. In this case, the bulb substantially does not enter the slot 8' but is supported by the upper surface 16 of the waveguide.

Figure 6:
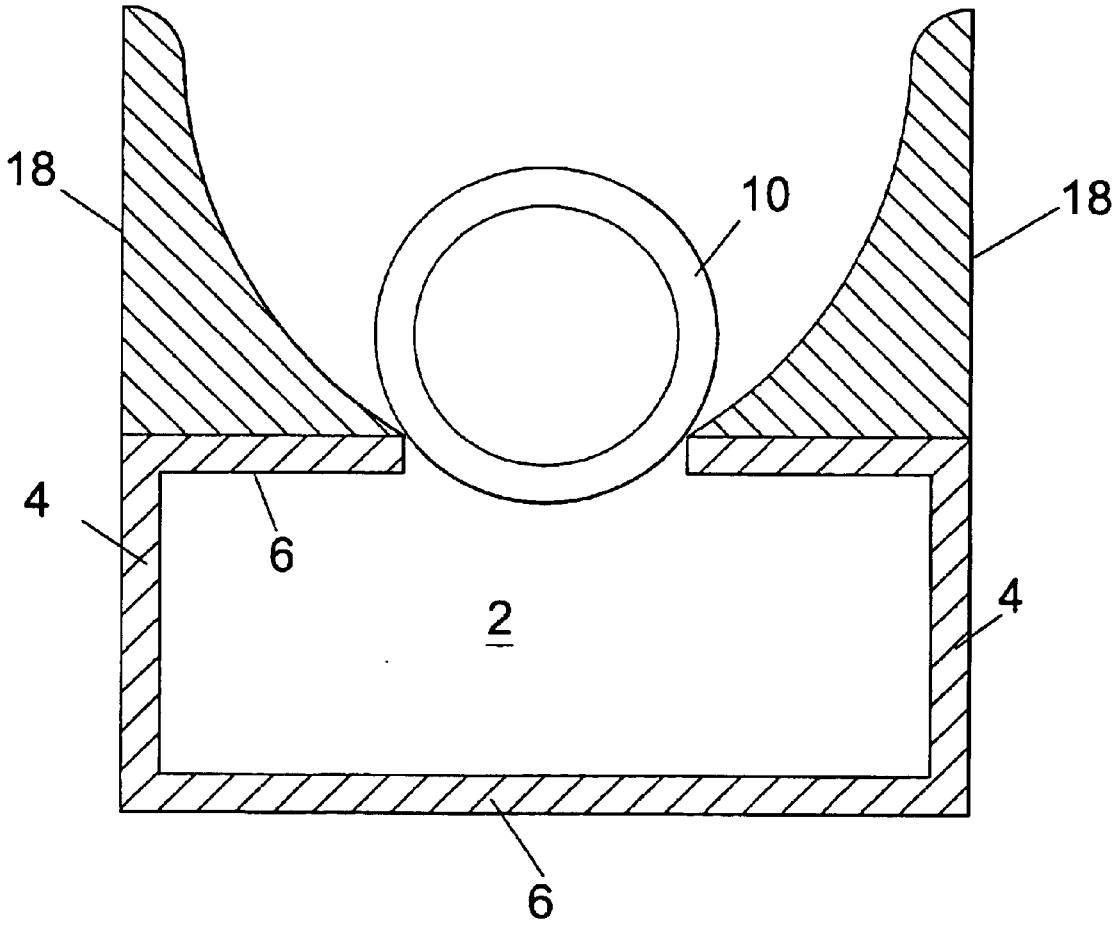
FIG. 6 is a cross-sectional view of the waveguide of FIG. 1 with a reflector.

With reference to FIG. 6, a reflector, preferably a focussing reflector, (for example a parabolic reflector) 18 may be formed on the upper surface of the waveguide 2 to focus light from the bulb 10 in a desired direction. The reflector 18 may be formed integrally with the waveguide 2 or may be formed separately and secured to the waveguide 2 in a separate operation.

It will be noted that it is relatively easy to machine complicated shapes into sheet metal material as is used for waveguide construction. It is easier thereby to compensate for variations in intensity using variations in slot width than by attempting to vary the construction of the quartz envelope of the microwave energisable lamp. This is a significant advantage over prior art constructions.

As discussed above, the construction may be inverted (relative to that shown in FIG. 2) and held above a conveyor belt web in order to illuminate the web with ultraviolet radiation. Similarly, additional units may be placed vertically to illuminate the sides of relatively tall articles passing along the conveyor web.

Depending on the relative power levels and the length of the slot 8, it is possible that some microwave energy will not be absorbed by the lamp 10. Since microwave energy in a waveguide may be viewed as a travelling wave, it will be noted that energy not absorbed in the slot is liable to be reflected back along the slot and the waveguide towards the source of microwave radiation. This is undesirable if such reflections are at high levels since it tends to disrupt the standing wave patterns within the waveguide and thereby disrupt illumination of the lamp 10 resulting in uneven illumination typically at half-wavelength intervals. Therefore, in appropriate applications, the distal end of the slot (marked 18 in FIG. 4A for example) may be furnished with "lossy" material which attenuates energy at microwave frequencies and thereby absorbs surplus energy rather than allowing it to become reflected by the end of the slot.

What is claimed is:

1. A coupler for coupling microwave energy directly into an elongate microwave energisable lamp comprising a generally rigid waveguide having a generally rectangular cross section and four generally planar, elongate walls, one of the walls defining a slot which passes through the entire thickness of the wall and is of non-uniform width along its length.

2. A coupler according to claim 1, wherein the waveguide walls are of differing widths and comprise a pair of wide walls and a pair of narrow walls, and wherein the slot is defined in one of the narrow walls.

3. A coupler according to claim 1 including a focussing reflector positioned adjacent the slot.

4. A coupler according to claim 1, wherein the slot width varies exponentially with length.

5. A coupler according to claim 1, wherein a first end of the coupler is arranged to receive microwave power from a power source such as a magnetron and wherein the slot is arranged to become wide with increasing distance from the first end.

6. A coupler according to claim 5, wherein the slot width varies exponentially with length.

7. A coupler according to claim 2, wherein the slot is of non-uniform width along its length.

8. A coupler according to claim 7, wherein the slot width varies exponentially with length.

9. A coupler according to claim 7, wherein a first end of the coupler is arranged to receive microwave power from a power source such as a magnetron and wherein the slot is arranged to become wide with increasing distance from the first end.

10. A coupler according to claim 9, wherein the slot width varies exponentially with length.

11. An elongate ultraviolet light source comprising an elongate microwave energisable electrodeless lamp and a generally rigid waveguide having a generally rectangular cross section and four generally planar, elongate walls, one of the walls defining a slot which passes through the entire thickness of the wall, the lamp being partially inserted into or laid over the slot and the waveguide being couplable to a source of microwave energy such as a magnetron.

12. An elongate ultraviolet light source comprising an elongate microwave energisable lamp and a generally rigid waveguide having a generally rectangular cross section and four generally planar, elongate walls, one of the walls defining a slot of non-uniform width along its length which passes through the entire thickness of the wall, the lamp being partially inserted into or laid over the slot and the waveguide being couplable to a source of microwave energy such as a magnetron.

13. An elongate ultraviolet light source comprising an elongate microwave energisable lamp and a generally rigid waveguide having a generally rectangular cross section and four generally planar, elongate walls, one of the walls defining a slot which passes through the entire thickness of the wall, the lamp being partially inserted into or laid over the slot and passing through no more than one wall of the waveguide, the waveguide being couplable to a source of microwave energy such as a magnetron.

* * * * *